US008459365B1

(12) United States Patent
Schultz et al.

(10) Patent No.: US 8,459,365 B1
(45) Date of Patent: Jun. 11, 2013

(54) APPARATUS FOR CREATING BIDIRECTIONAL ROTARY FORCE OR MOTION IN A DOWNHOLE DEVICE AND METHOD FOR USING SAME

(75) Inventors: Roger L. Schultz, Ninnekah, OK (US); Brock Watson, Oklahoma City, OK (US); Andrew Ferguson, Moore, OK (US); Stanley W. Loving, Port Aransas, TX (US)

(73) Assignee: Thru Tubing Solutions, Inc., Oklahoma City, OK (US)

( * ) Notice: Subject to any disclaimer, the term of this patent is extended or adjusted under 35 U.S.C. 154(b) by 0 days.

(21) Appl. No.: 13/591,183

(22) Filed: Aug. 21, 2012

(51) Int. Cl.

| | |
|---|---|
| ***E21B 23/00*** | (2006.01) |
| ***E21B 34/14*** | (2006.01) |
| ***E21B 34/12*** | (2006.01) |
| ***F16K 3/34*** | (2006.01) |

(52) U.S. Cl.
USPC ..... 166/381; 166/332.4; 166/334.1; 251/208

(58) Field of Classification Search
USPC ..... 166/332.4, 334.1, 334.4, 381; 251/208, 251/304, 292; 464/163–166
See application file for complete search history.

(56) References Cited

U.S. PATENT DOCUMENTS 3,483,922 A * 12/1969 McEver, Jr. ..... 166/128
4,105,069 A * 8/1978 Baker ..... 166/51

* cited by examiner

*Primary Examiner* — Shane Bomar
*Assistant Examiner* — Wei Wang
(74) *Attorney, Agent, or Firm* — Belair Intellectual Property Law LLC

(57) ABSTRACT

A downhole bidirectional apparatus, including a first engagement section; a second engagement section having a rotary device; a third engagement section; and a rotary source having a first rotary member and a second rotary member, the first rotary member disposed about the second rotary member, the first rotary member connected to a first gripping member and the second rotary member connected with a second gripping member, wherein the rotary device is rotatable in a first rotational direction when the second gripping member is engaged with the third engagement section and the first gripping member is rotatably engaged with the second engagement section, and wherein the rotary device is rotatable in a second rotational direction when the second gripping member is engaged with the second engagement section and the first gripping member is engaged with the first engagement section.

25 Claims, 8 Drawing Sheets

100
202
112
207
204
110
205
102, 104, 106
206
302
306
304
208
210
212
310
308
312
214
300
318
316
314
319
216
7
218
320
324
220
326
224
8
222
328
332
334

311
323
331

APPARATUS FOR CREATING BIDIRECTIONAL ROTARY FORCE OR MOTION IN A DOWNHOLE DEVICE AND METHOD FOR USING SAME

TECHNICAL FIELD OF THE INVENTION

This invention relates, in general, to an apparatus for creating bidirectional rotary force or motion in a wellbore that traverses a subterranean hydrocarbon bearing formation and, in particular, to an apparatus for creating bidirectional rotary force or motion in a downhole device and method for using same.

BACKGROUND OF THE INVENTION

Without limiting the scope of the present invention, its background will be described in relation to an apparatus for creating bidirectional rotary force or motion in a downhole device and method for using same, as an example.

In producing oil and gas, many different processes, tools, and the like are employed. Oftentimes, the processes and tools used may become impediments to subsequent processes. For example, hydraulic fracturing a well typically includes drilling a wellbore, such as a horizontal wellbore through hydrocarbon bearing formations. Typically, once the wellbore is drilled, casing is run into the wellbore and cemented in place. Once cemented, one or more tools are run into the wellbore to perforate the casing, cement, and formation. These perforating devices may be any types commonly known, such as abrasive or pyrotechnic perforators. The perforating devices create perforations through the casing, cement, and formation for enabling a fracturing fluid to be pumped under high pressure from the passageway of the casing string through the perforations into the formations to create fractures in the formation for improving the recovery of hydrocarbons in a particular zone of the well.

To fracture another zone above the one previously fractured, a drillable bridge plug, a setting tool, and a perforating device may be run into the well via an electricline, wireline, and the like. These tools may be transported through the horizontal sections of the well with a fluid. The bridge plug is then set with the setting tool, and then the perforating device may be operated to perforate the wellbore above where the bridge plug is set. After perforating the zone, the setting tool and perforating device may be removed from the wellbore and fracturing fluid with proppant may be pumped into the zone to fracture the formation. The process may be repeated as many times as desired.

All of these set bridge plugs seal the central passageway within the casing and prevents hydrocarbons from being produced through the casing. To clear the bridge plugs from the passageway, additional tools may be run into the wellbore to mechanically mill or grind them to clear the passageway. This method is known as "plug and perf."

An alternative to the plug and perf method is to incorporate sleeve valves with ports in the casing string. The sleeve valves are spaced out along the casing string prior to running them into the wellbore. Once the casing string is run into the wellbore, the lower or bottom sleeve valve may be opened, exposing ports in the sleeve valve creating a passageway from the inner casing to the formation substantially adjacent to the sleeve valve. Typically, these sleeve valves are opened by applying a fluid under pressure to the sleeve valve to be opened. Once the sleeve valve is opened, fracturing fluid with proppant is pumped to the bottom zone and through the sleeve valve to fracture the bottom zone of the formation.

When a sufficient amount of proppant is injected into the fractured formation, a drillable ball may be dropped into the fluid which flows with the fluid to the opened sleeve valve. Typically, each of the sleeve valves includes a seat or baffle that the ball lands on. The baffle of the lowermost sleeve valve is smaller in diameter than the seat of the sleeve valve located above it. The diameter of the baffles of the sleeve valves are progressively smaller to larger from the bottom to the top of the wellbore. A small ball is dropped first and seals to a baffle that is directly above the zone that was just fractured, thus closing off fluid communication to the opened sleeve valve. Once the ball seats against the baffle, the fluid pressure increases causing the sleeve valve located above the sealed baffle to shift open. This then opens ports in the sleeve valve. This fracturing process may be repeated by dropping balls having increasing size to seal off sleeve valves of increasing baffle size from the toe to the heel of the wellbore. One problem with this method is that all of the seated balls must then be mechanically milled out the balls and baffles to clear the inner diameter of the wellbore passageway. In addition, ball and baffle systems are limited because of the available ball size increments, thus they limit the number of valves that can be run on a single casing string.

Another problem associated with this method is that the sleeve valves open axially linearly, thus requiring a need for an area or space for the sleeve to slide linearly into when opening to expose the ports.

Yet another problem with ball and baffle methods is during the cementing operation, cement becomes lodged in the baffles disposed within the casing string. The conventional cementing method is to run in a casing string into the wellbore, set a cement plug, and put a column of cement behind the first cement plug on the bottom. Additionally, another plug may be put on the top of the cement to isolate it from a fluid, such as mud, above that is used to push the cement column between the wellbore and the outer surface of the casing string. Existing baffles in the casing string interfere with the plugs providing a clean wipe down through the casing string passageway. Plus, the lower baffle may have such a small opening, that plugs may have a difficulty passing through the baffle and also because some of the cement accumulates around the baffle. This can be a further problem when a sleeve valve that must move axially is impeded by the cement disposed within the inner passageway of the casing string.

Also, conventional systems and methods may use swellable packers that are disposed between the outside of the casing string and the wellbore isolating the fracturing zones. In such cases, swellable packers are used in place of cement.

SUMMARY OF THE INVENTION

The present invention disclosed herein is directed to an apparatus for creating bidirectional rotary force or motion in a downhole device and method for using same ("downhole bidirectional apparatus") that provides bidirectional rotary force or motion to downhole devices and tools operated in a wellbore that traverse a subterranean hydrocarbon bearing formation.

In one embodiment, the present invention is directed to an downhole bidirectional apparatus, including a first engagement section; a second engagement section having a rotary device; a third engagement section; and a rotary source having a first rotary member and a second rotary member, the first rotary member disposed about the second rotary member, the first rotary member connected to a first gripping member and the second rotary member connected with a second gripping member, wherein the rotary device is rotatable in a first rotational direction when the second gripping member is engaged with the third engagement section and the first gripping member is rotatably engaged with the second engagement section, and wherein the rotary device is rotatable in a second rotational direction when the second gripping member is engaged with the second engagement section and the first gripping member is engaged with the first engagement section.

In one aspect, the downhole bidirectional apparatus may further include a swivel in communication with rotary source. In another aspect, the first engagement section, second engagement section, and third engagement section may have one or more lugs disposed about the periphery of their inner surface. Also, the first engagement section, second engagement section, and third engagement section may have one or more grooves formed axially in their inner surface. In yet another aspect, the first and second gripping members may have one or more extendable dogs.

In still yet another aspect, the extendable dogs may be extended by hydraulically operated pistons. Additionally, the first and second gripping members may have one or more radially extended splines. Also, the downhole bidirectional apparatus may further include at least one stop for stopping the rotation of rotary device. The rotary device may have at least one port disposed therethrough. In one aspect, the rotary device may be a rotary sleeve. In another aspect, the rotary device may be a rotary set packer. In yet another aspect, the rotary device may be a rotary set bridge plug.

In another embodiment, the present invention is directed to a downhole bidirectional apparatus, including a circumferentially rotatable downhole device, including an inner mandrel; a driving member slidably disposed about the inner mandrel; an outer mandrel disposed about the driving member; an operating member disposed about the outer surface of the outer mandrel, the operating member being operated by movement of the driving member; a tool for operating the circumferentially rotatable downhole device, including a rotary source having an inner rotary member and an outer rotary member disposed about the inner rotary member, the inner rotary member connected to a second gripping member and the outer rotary member connected with a first gripping member, wherein the driving member moves axially linearly in a first direction when the first gripping member is engaged with the outer mandrel and the second gripping member is engaged with the driving member, and wherein the driving member moves axially linearly in a second direction when the first gripping member is engaged with the driving member and the second gripping member is engaged with the inner mandrel.

In one aspect, the driving member and the outer mandrel may be engaged in a threaded connection, wherein rotating one of the driving member and the outer mandrel operates the operating member. In another aspect, the first gripping member may have one or more radially inwardly extending splines. Also, the second gripping member may have one or more radially inwardly extending splines. Additionally, the inner mandrel may have one or more radially outwardly extending splines. In still yet another aspect, the driving member may have one or more radially outwardly extending splines. In one aspect, the outer mandrel may have one or more radially outwardly extending splines.

In yet another embodiment, the present invention is directed to a method for operating a downhole tool, including positioning a bidirectional rotary device into a wellbore; engaging a unidirectional rotary source to the bidirectional rotary device in a first position; operating the unidirectional rotary source to operate the bidirectional rotary device in a first rotational direction; engaging the unidirectional rotary source to the bidirectional rotary device in a second position; and operating the unidirectional motor to operate the bidirectional rotary device in a second rotational direction.

In one aspect, operating the unidirectional motor may include pumping a fluid through the unidirectional rotary source. In another aspect, engaging the unidirectional rotary source to the bidirectional rotary device in a second position may include moving the unidirectional rotary source axially relative to the bidirectional rotary device from the first position to the second position. In still yet another aspect, operating the unidirectional rotary source may further include operating the unidirectional rotary source continuously during moving the unidirectional rotary source. Also, engaging the unidirectional rotary source may further include engaging the unidirectional rotary source with external splines on the bidirectional rotary device. In one aspect, engaging the unidirectional rotary source may further include engaging the unidirectional rotary source with internal splines on the bidirectional rotary device. In another aspect, engaging the unidirectional motor may further include engaging the unidirectional motor with internal dogs on the bidirectional rotary device. In still yet another aspect, operating the bidirectional rotary device may further include rotating the bidirectional rotary device to produce an axially linear force.

In still yet another embodiment, the present invention is directed to a method for fracturing a wellbore in a formation, including positioning one or more bidirectional rotary sleeves on tubular members into the wellbore; engaging a unidirectional rotary source in a first position with a first bidirectional rotary sleeve of the one or more bidirectional rotary sleeves; operating the unidirectional rotary source to rotate the first bidirectional rotary sleeve in a first rotational direction to open at least one port in the first bidirectional rotary sleeve for providing an open fluid pathway between the first bidirectional rotary sleeve and the formation; pumping fluid through the tubular members and through the opened port to fracture the formation; engaging the unidirectional rotary source in a second position with the first bidirectional rotary sleeve; and operating the unidirectional rotary source to rotate the first bidirectional rotary sleeve in a second rotational direction to close the at least one port in the first bidirectional rotary sleeve.

In one aspect, the method may further include engaging the unidirectional rotary source in a first position with a second bidirectional rotary sleeve of the one or more bidirectional rotary sleeves; operating the unidirectional rotary source to rotate the second bidirectional rotary sleeve in a first rotational direction to open at least one port in the second bidirectional rotary sleeve for providing an open fluid pathway between the second bidirectional rotary sleeve and the formation; pumping fluid through the tubular members and through the opened port to fracture the formation; engaging the unidirectional rotary source in a second position to the second bidirectional rotary sleeve; and operating the unidirectional rotary source to rotate the second bidirectional rotary sleeve in a second rotational direction to close the at least one port in the second bidirectional rotary sleeve.

Additionally, the method may include opening one or more of the one or more bidirectional rotary sleeves after fracturing the wellbore in the formation to provide fluid production in the tubular members. In another aspect, the engaging a unidirectional rotary source may further include positioning the unidirectional rotary source with coiled tubing into the tubular members. Also, the engaging the unidirectional rotary source may further include mating splines of the unidirectional rotary source with splines on the one or more bidirectional rotary sleeves.

BRIEF DESCRIPTION OF THE DRAWINGS

For a more complete understanding of the features and advantages of the present invention, reference is now made to the detailed description of the invention along with the accompanying figures in which corresponding numerals in the different figures refer to corresponding parts and in which.

DETAILED DESCRIPTION OF THE INVENTION

While the making and using of various embodiments of the present invention are discussed in detail below, it should be appreciated that the present invention provides many applicable inventive concepts which can be embodied in a wide variety of specific contexts. The specific embodiments discussed herein are merely illustrative of specific ways to make and use the invention, and do not delimit the scope of the present invention.

In the following description of the representative embodiments of the invention, directional terms, such as "above", "below", "upper", "lower", etc., are used for convenience in referring to the accompanying drawings. In general, "above", "upper", "upward" and similar terms refer to a direction toward the earth's surface along a wellbore, and "below", "lower", "downward" and similar terms refer to a direction away from the earth's surface along the wellbore.

Figure 1A:
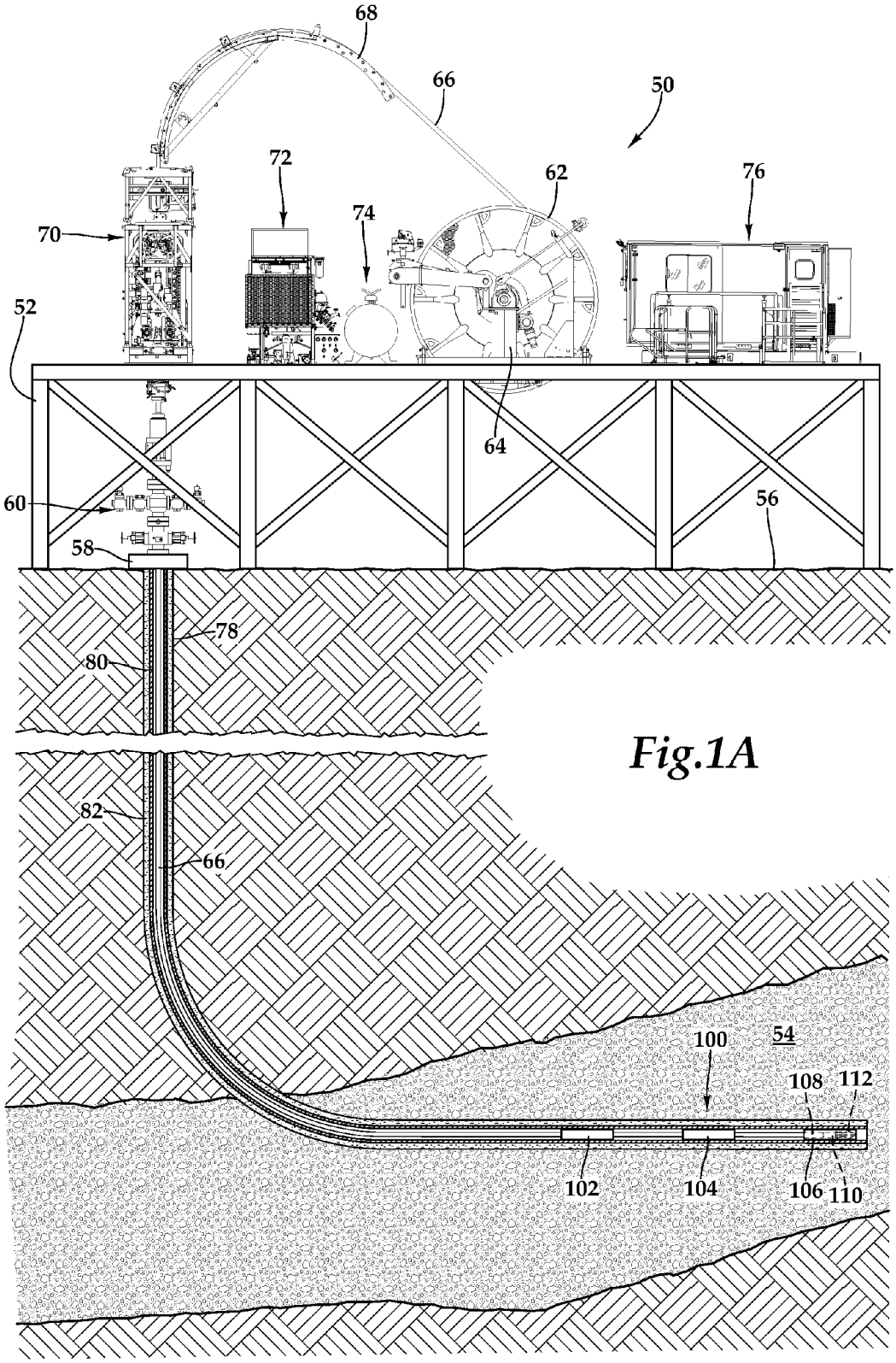
FIG. 1A is a schematic illustration of an onshore platform in operable communication with a downhole bidirectional apparatus in a connected work string according to an embodiment.
Figure 1B:
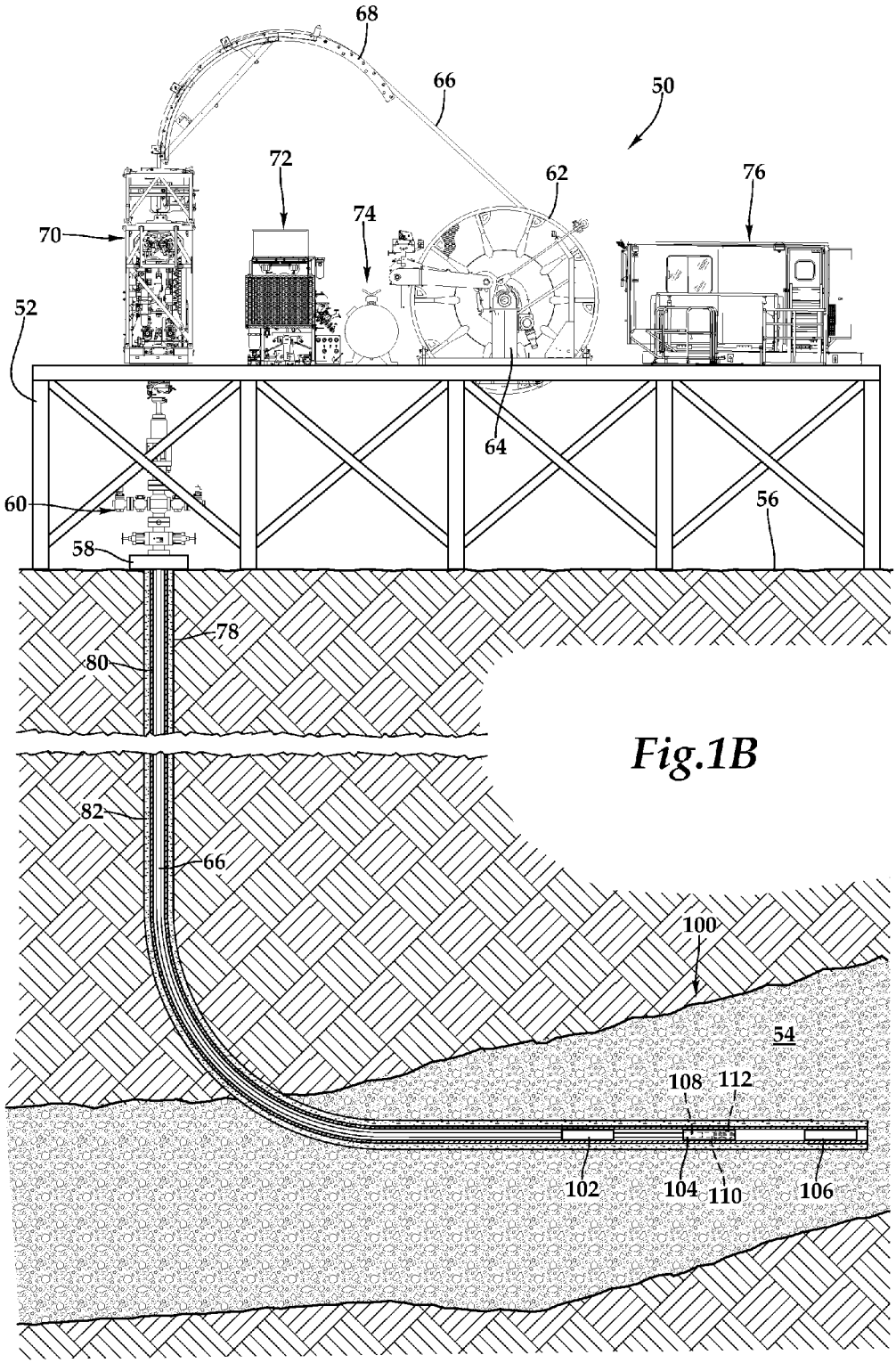
FIG. 1B is a schematic illustration of an onshore platform in operable communication with a downhole bidirectional apparatus in a connected work string according to another embodiment.

Referring to FIGS. 1*a*-1B, a downhole bidirectional apparatus 100 in use with an onshore oil and gas drilling or production platform is schematically illustrated and generally designated 50. A platform 52 is located over subterranean oil and gas formation 54 located below ground 56. A wellhead installation 58, including blowout preventers 60, are located on ground 56 for providing fluid communication and control between formation 54 and oil and gas operations located on platform 52, such as a coiled tubing unit, for example. Although a coiled tubing unit is shown, downhole bidirectional apparatus may be used with any types of tubular members and the like, such as conventional tubing apparatuses and methods.

Coiled tubing unit may include a spool 62 that may be supported by a support 64 on platform 52. Coiled tubing 66 is wound around spool 62 and disposed about a guide 68 for providing coiled tubing 66 to an injector 70 for providing a force to feed coiled tubing 66 into a wellbore 78. Coiled tubing unit may further include an engine 72 for providing power to the units of coiled tubing unit. Additionally, it may include a hydraulic tank 74 for providing a fluid into wellbore 78 as described below. Coiled tubing unit may further include a control room or unit 76 for controlling the operations of coiled tubing unit, for example.

Wellbore 78 extends through the various earth strata including formation 54. A casing 80 is cemented within a vertical and horizontal section of wellbore 78 by cement 82. Even though FIGS. 1A-1B depict one lateral wellbore 78, it should be understood by those skilled in the art that downhole bidirectional apparatus may be used in conjunction with any number of casing strings to produce any number of lateral wellbores.

In addition, even though FIGS. 1A-1B depict a downhole bidirectional apparatus in a horizontal wellbore, it should be understood by those skilled in the art that the downhole bidirectional apparatus is equally well suited for use in wells having other directional configurations including horizontal wells, vertical wells, deviated wellbores, slanted wells, multilateral wells and the like.

Downhole bidirectional apparatus 100 may include one or more rotary devices 102, 104, 106 as shown in the horizontal section of casing 80 in wellbore 78. Although three rotary devices 102, 104, 106 are shown in FIGS. 1A-1B, any number of rotary devices 102, 104, 106 may be included with the present downhole bidirectional apparatus. Downhole bidirectional apparatus 100 may also include a swivel 108 and a rotary source 110 for powering a gripping device 112. In one aspect, rotary source 110 rotates in one direction and creates left-hand or right-hand torque in rotary devices 102, 104, 106 by only using right-hand torque output of rotary source 110. In another embodiment, rotary source 110 rotates in another direction and creates left-hand or right-hand torque in rotary devices 102, 104, 106 by only using left-hand torque output of rotary source 110. In one embodiment, swivel 108 enables one of rotary device 110 or gripping device 112 to rotate relative to the other depending on the location of gripping device 112 as described below.

As shown in FIG. 1A, gripping device 112 is located substantially adjacent to the lowermost rotary device 106 for operating rotary device 106 in accordance with the description herein. As shown in FIG. 1B, swivel 108, rotary source 110, and gripping device 112 are shown operating the next rotary device 104 in casing 80. In accordance with the present invention, swivel 108, rotary source 110, and gripping device 112 may be moved from any rotary devices 102, 104, 106 to any other rotary devices 102, 104, 106 as desired for selectively opening rotary devices 102, 104, 106.

In one aspect, any of rotary devices 102, 104, 106 may be opened with rotary source 110 and gripping device 112. For example, an operation may require that every other rotary devices 102, 104, 106 is operated followed by operating the other rotary devices 102, 104, 106. Further, any of rotary devices 102, 104, 106 once opened may be closed at a later time, such as if in the case of a valve that particular zone adjacent to one of rotary devices 102, 104, 106 is producing water. As described herein, rotary devices 102, 104, 106 may be any type of downhole device, including tools, valves, sleeves, and the like that operate generally by application of a rotary force or torque. Additionally, rotary devices 102, 104, 106 once closed after initial operation, may then be re-opened to re-fracture that particular zone. Also, the present downhole bidirectional apparatus provides for selectively opening, closing, and/or operating any of rotary devices 102, 104, 106 without having to isolate zones located above or below a particular rotary devices 102, 104, 106.

In one embodiment, swivel 108, rotary source 110, and gripping device 112 are run into casing 80 of wellbore on the end of coiled tubing 66. In addition to providing support and force for running in swivel 108, rotary source 110, and gripping device 112 into casing 80 in wellbore 78, coiled tubing 66 may further provide a fluid conduit and/or fluid communication for providing fluid under pressure to downhole bidirectional apparatus 100.

Figures 2A, 2B, 3:
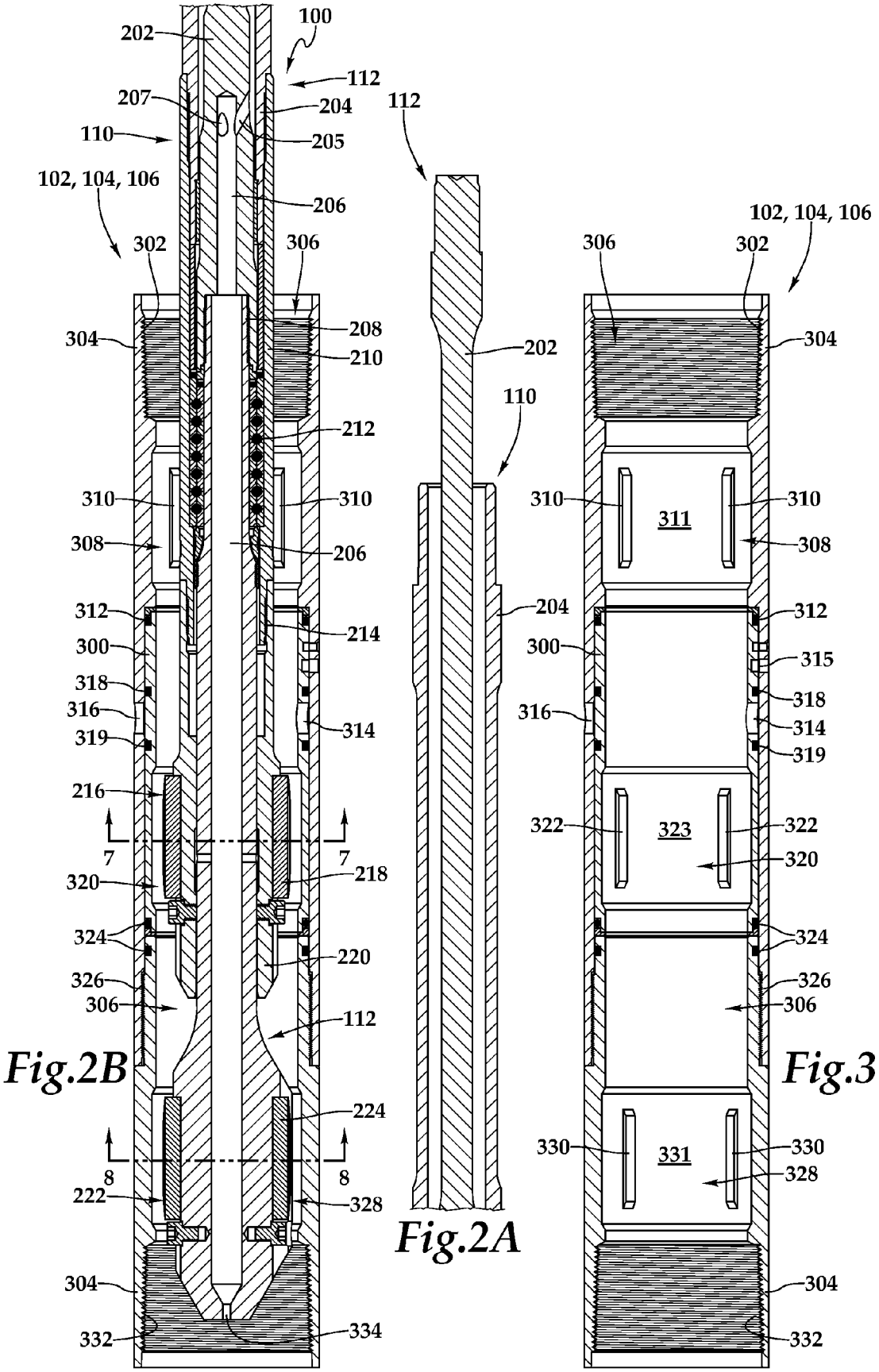
FIGS. 2A-2B are cross-sectional views of a downhole bidirectional apparatus with a rotary sleeve operable in a first direction according to an embodiment.
FIG. 3 is a cross-sectional view of a rotary device in a closed position of the downhole bidirectional apparatus of FIGS. 2A-2B according to an embodiment.

Referring to FIGS. 2A-2B and 3, one embodiment of a downhole bidirectional apparatus is schematically illustrated and generally designated 100. Rotary source 110 may include a first rotary member 204 and a second rotary member 202 for providing a unidirectional rotation of first rotary member 204 and/or second rotary member 202. As discussed further below, rotary source 110 may be any type of device, tool, motor, and the like that provides rotary motion downhole to rotary devices 102, 104, 106 via first rotary member 204 and/or second rotary member 202.

In one embodiment, rotary source 110 provides a unidirectional rotation of second rotary member 202 relative to first rotary member 204 when first rotary member 204 is in non-rotational engagement with rotary devices 102, 104, 106 as further discussed below. Further, swivel 108 enables first rotary member 204 to rotate in an opposite direction when second rotary member 202 is in non-rotational engagement with rotary devices 102, 104, 106 as further described below. Preferably, rotary source 110 is any type of device, tool, motor, and the like that is connectable with swivel 108 to enable this type of relative rotation between first rotary member 204 and second rotary member 202 for providing bidirectional rotation of gripping members when they are engaged with rotary devices 102, 104, 106 as further described below. Some exemplary types of rotary sources 110 may include pneumatically operated rotary sources, hydraulically operated rotary sources, electrically operated rotary sources, mechanically operated rotary sources, and the like.

In one embodiment, rotary source 110 may be a mud motor having a rotor and a stator where second rotary member 202 is an extension, such as an output shaft, of the rotor and first rotary member 204 is a extension of the stator of the motor. These extensions, first rotary member 204 and second rotary member 202, may be members that are connected directly to the rotor and stator, respectively, of rotary source 110 or they may be in structural communication with rotor and stator via a further extensions or members.

The annulus between first rotary member 204 and second rotary member 202 provides a pathway for fluid to communicate to a central passageway 206 of second rotary member 202 via passageway 205 and port 207. Second rotary member 202 may be connected to an inner mandrel 208 and first rotary member 204 may be connected to an outer mandrel 210 via threaded connection 214. Inner mandrel 208 is in rotatable communication with outer mandrel 210 via thrust bearings 212 that are disposed between inner mandrel 208 and outer mandrel 210, in one aspect. Outer mandrel 210 extends to a first gripping member 216 that includes one or more hydraulically powered dogs 218. Inner mandrel 208 extends to a second gripping member 222 that includes one or more hydraulically powered dogs 224. Outer mandrel 210 may extend past first gripping member 216 at an outer mandrel 220.

Rotary devices 102, 104, 106 may include a threaded connector 302 for connecting with tubular members of a casing string, such as casing 80. Rotary devices 102, 104, 106 include tubular bodies/body 304 defining a central passageway 306 for accepting rotary source 110 and gripping device 112, in one embodiment. Rotary devices 102, 104, 106 may further include a first lug section 308 including one or more lugs 310 for engaging with dogs 218 of first gripping member 216, for example. Additionally, first lug section 308 may include or be part of a tubular inset 311 that is pressed, attached, connected, and/or disposed, about the inside periphery of tubular body 304, in one embodiment. Also, rotary devices 102, 104, 106 may be a rotary sleeve 300 that is in rotatable engagement with tubular body 304. Rotary devices 102, 104, 106 may further include seals 312, 318, 319, 324 for providing a sealing engagement between tubular body 304 and rotary sleeve 300, in one aspect.

In one embodiment, tubular inset 311 and tubular body 304 is a two-piece or multi-piece construction that are joined together. In another embodiment, tubular body 304 is formed with first lug section 308 as part of tubular body 304, and lugs 310 and tubular inset 311 is not required to be pressed into tubular body 304.

Figure 5:
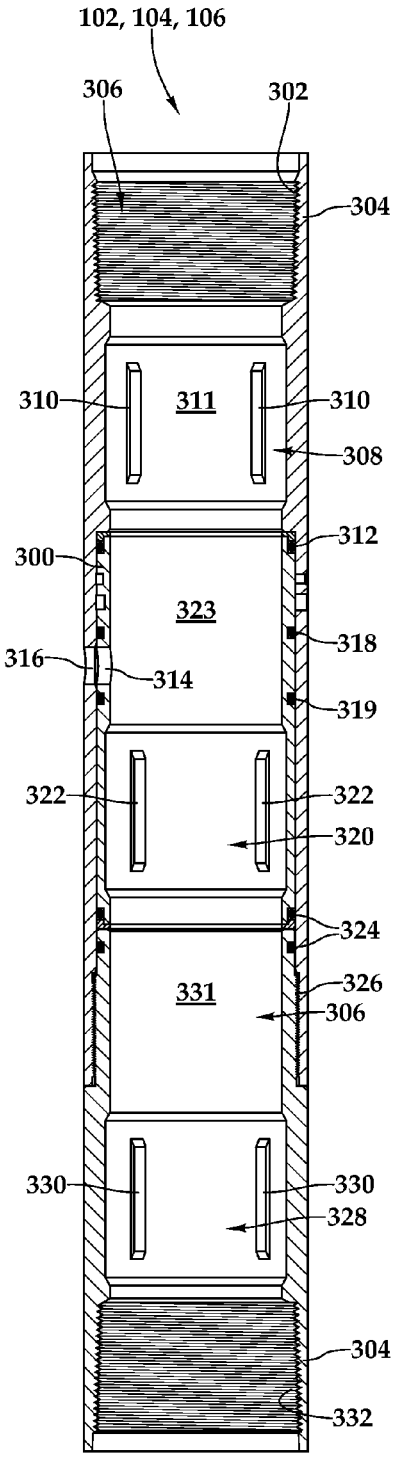
FIG. 5 is a cross-sectional view of a rotary sleeve of FIGS. 4A-4B in an open position according to an embodiment.

Rotary sleeve 300 is disposed within tubular body 304 and is rotatable about the main axis of tubular body 304. It may rotate to the right or left depending on the torque being applied to it by gripping device 112. Rotary sleeve 300 also includes one or more holes or ports 314 that may either align with one or more ports 316 of tubular body 304 depending on the rotation of rotary sleeve 300 as best shown in FIG. 5. FIG. 3 shows ports 314 not in alignment with 316. Rotary sleeve 300 may include stops 315 for preventing the rotation of rotary sleeve 300 beyond a certain point, such as to stall rotary source 110 once ports 314 are aligned with ports 316, for example. Additionally, stops may be used to prevent over rotation of rotary sleeve 300 beyond any other desired points.

Rotary devices 102, 104, 106 may also include a second lug section 320 including one or more lugs 322 for engaging with dogs 218 of first gripping member 216 and/or dogs 224 of second gripping member 222, as further described below. Second lug section 320 and lugs 322 are part of rotary sleeve 300 in one embodiment. Additionally, second lug section 320 may include a tubular inset 323 that is pressed, attached, connected, disposed, about the inside periphery of rotary sleeve 300, in one embodiment. In one embodiment, tubular inset 323 and rotary sleeve 300 are a two-piece or multi-piece construction that are joined together. In another embodiment, rotary sleeve 300 is formed with second lug section 320 and lugs 322 and tubular inset 323 is not required to be pressed into rotary sleeve 300. Tubular body 304 may be joined together just below rotary sleeve 300 by a threaded connection 326.

Rotary devices 102, 104, 106 may also include a third lug section 328 including one or more lugs 330 for engaging with dogs 224 of second gripping member 222, as further described below. Additionally, third lug section 328 may include a tubular inset 331 that is pressed, attached, connected, disposed, about the inside periphery of tubular body 304, in one embodiment. In one embodiment, tubular inset 331 and tubular body 304 is a two-piece or multi-piece construction that are joined together. In another embodiment, tubular body 304 is formed with third lug section 328 and lugs 330 and tubular inset 313 is not required to be pressed into tubular body 304. Tubular body 304 may be joined together just below rotary sleeve 300 by a threaded connection 326. Rotary devices 102, 104, 106 may further include a threaded end 332 for coupling with additional tubular members of casing 80, for example. In one embodiment, gripping device 112 may include a back pressure orifice 334 for controlling the back pressure through passageway 206.

Figure 4A:
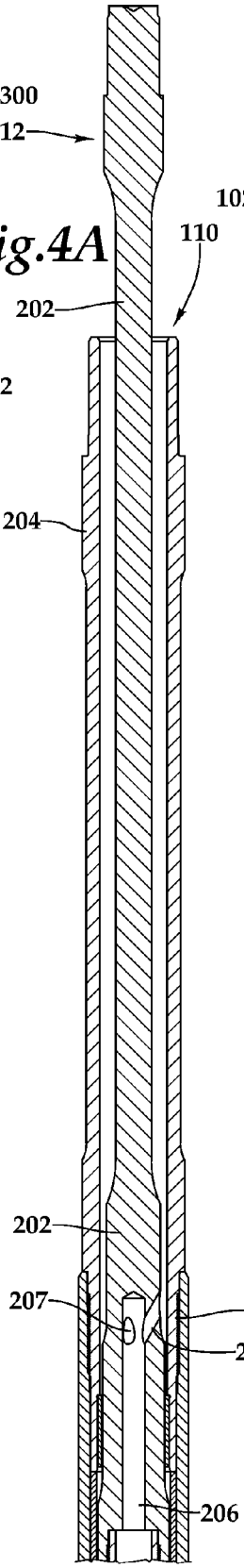
FIGS. 4A-4B are cross-sectional views of a downhole bidirectional apparatus with a rotary sleeve of FIGS. 2A-2B operable in a second direction according to an embodiment.
Figure 4B:
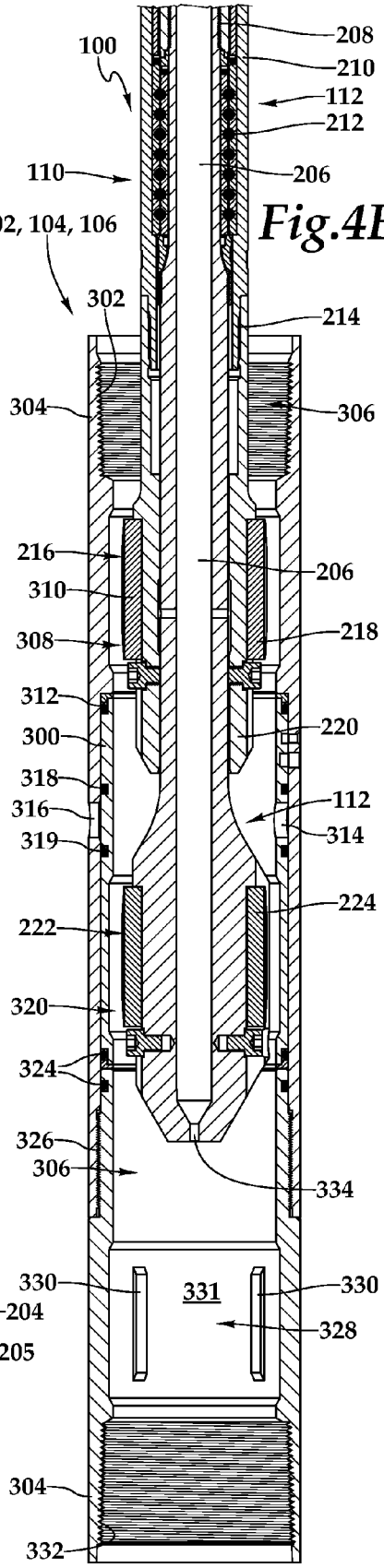

As shown in FIGS. 2A-2B, first gripping member 216 is engaged with second lug section 320 and second gripping member 222 is engaged with third lug section 328 for rotating rotary sleeve 300. With reference now to FIGS. 4A-4B, rotary source 110 and gripping device 112 are shown positioned or moved up relative to their positions in FIGS. 2A-2B within rotary devices 102, 104, 106 such that first gripping member 216 is now engaged with first lug section 308 and second gripping member 222 is now engaged with second lug section 320 for rotating rotary sleeve 300 in the opposite direction as that described and shown in FIGS. 2A-2B. This bidirectional rotary force or motion provided by downhole bidirectional apparatus is produced by locating gripping device 112 in a specific set of lug sections and operating rotary source 110 to rotate rotary devices 102, 104, 106 in one direction or the other as follows.

As shown in FIGS. 2A-2B, second gripping member 222 is shown engaged with lugs 330 of third lug section 328 and first gripping member 216 is shown engaged with lugs 322 of second lug section 320. Lugs 330 of third lug section 328 are stationary relative to rotatable lugs 322 of second lug section 320 of rotary sleeve 300 during its operation. When rotary source 110 is operated, second gripping member 222 remains stationary relative to first gripping member 216 and rotary sleeve 300 is rotated in a first direction by first gripping member 216. As shown in FIGS. 4A-4B, second gripping member 222 is shown engaged with lugs 322 of second lug section 320 and first gripping member 216 is shown engaged with lugs 310 of first lug section 308. Lugs 310 of first lug section 308 are stationary relative to lugs 322 of second lug section 320 of rotary sleeve 300. When rotary source 110 is operated, first gripping member 216 remains stationary relative to rotary sleeve 300 and rotary sleeve 300 is rotated in a second or opposite direction to that of first direction by second gripping member 222. Swivel 108 enables rotary source 110 to be rotated relative to second gripping member 222 when it is in a stationary position. This enables downhole bidirectional apparatus to provide bidirectional rotary force or motion to rotary devices 102, 104, 106 with a unidirectional rotary source 110, in one embodiment.

Figure 6:
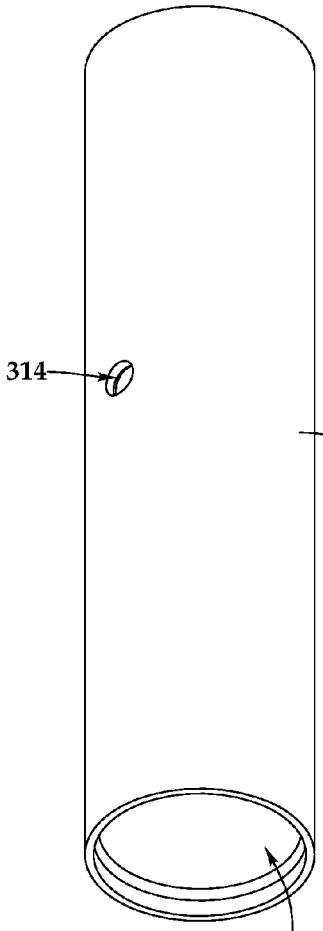
FIG. 6 is a perspective view of a rotary sleeve according to an embodiment.

Referring now to FIG. 6, rotary sleeve 300 is shown in a perspective view having one or more ports 314. In one embodiment, tubular body 304 may have an inner recess that is milled or formed into it that substantially accepts rotary sleeve 300 for providing a smooth inner wall surface throughout rotary devices 102, 104, 106, in one embodiment.

Figure 7:
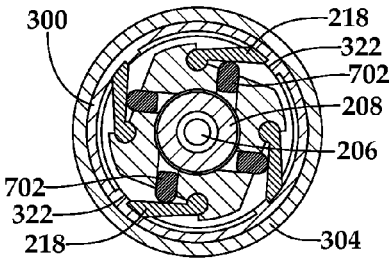
FIG. 7 is a cross-sectional view of the downhole bidirectional apparatus of FIG. 2B taken along line 7-7.

Turning now to FIG. 7, a cross-sectional view of first gripping member 216 engaged with second lug section 320 is shown. In this embodiment, dogs 218 of first gripping member 216 are hydraulically operated by pistons 702 to move dogs 218 inward and outward relative to lugs 322. FIG. 7 shows dogs 218 extended outwardly by pistons 702 and engaged with lugs 322 for rotating rotary sleeve 300 within tubular body 304. Pistons 702 are hydraulically operated by fluid under pressure within passageway 206, in one embodiment. When fluid pressure is decreased, pistons 702 extend inwardly causing dogs 218 to extend inwardly for disengaging with lugs 322. In one embodiment, dogs 218 extend outwardly for engaging with lugs 322 and rotating rotary sleeve 300 in one direction, such as clockwise rotation as shown in FIG. 7.

Figure 8:
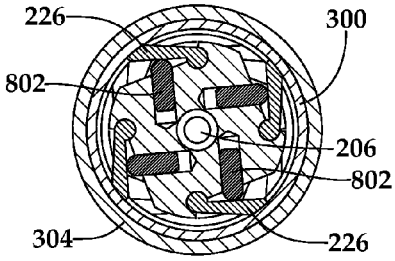
FIG. 8 is a cross-sectional view of the downhole bidirectional apparatus of FIG. 2B taken along line 8-8.

Referring now to FIG. 8, a cross-sectional view of second gripping member 222 engaged with third lug section 328 is shown. In this embodiment, dogs 224 of second gripping member 222 are hydraulically operated by pistons 802 to move dogs 224 inward and outward relative to lugs 330. FIG. 8 shows dogs 224 extended outwardly by pistons 802 and engaged with lugs 330 for rotating rotary sleeve 300 within tubular body 304 in an opposite or different direction than that described above relative to FIG. 7. Pistons 802 are hydraulically operated by fluid under pressure within passageway 206, in one embodiment. When fluid pressure is decreased, pistons 802 extend inwardly causing dogs 224 to extend inwardly for disengaging with lugs 330. In one embodiment, dogs 224 extend outwardly for engaging with lugs 330 and rotating rotary sleeve 300 in one direction, such as counterclockwise rotation as shown in FIG. 8.

Rotary devices 102, 104, 106 of downhole bidirectional apparatus 100 may include any number of lugs disposed within the inner surface or periphery of rotary devices 102, 104, 106. As shown in FIGS. 7-8, there are four dogs spaced substantially equally apart about the inner surface of first lug section 308, second lug section 320, and third lug section 328. Although four lugs per lug section are shown, downhole bidirectional apparatus may include any number of lugs or arrangement of lugs within rotary devices 102, 104, 106, for example.

In yet another embodiment, grips may be extendable without the use of pistons. In this embodiment, grips may be hydraulic pads that are hydraulically extended outward and inward due to the fluid pressure within passageway 206, for example. These hydraulic pads may extend radially outward due to the pressure differential on opposite ends of hydraulic pads. In still yet another embodiment, dogs may be may be extended due to centrifugal force caused by the rotation of gripping device 112.

Figure 9B:
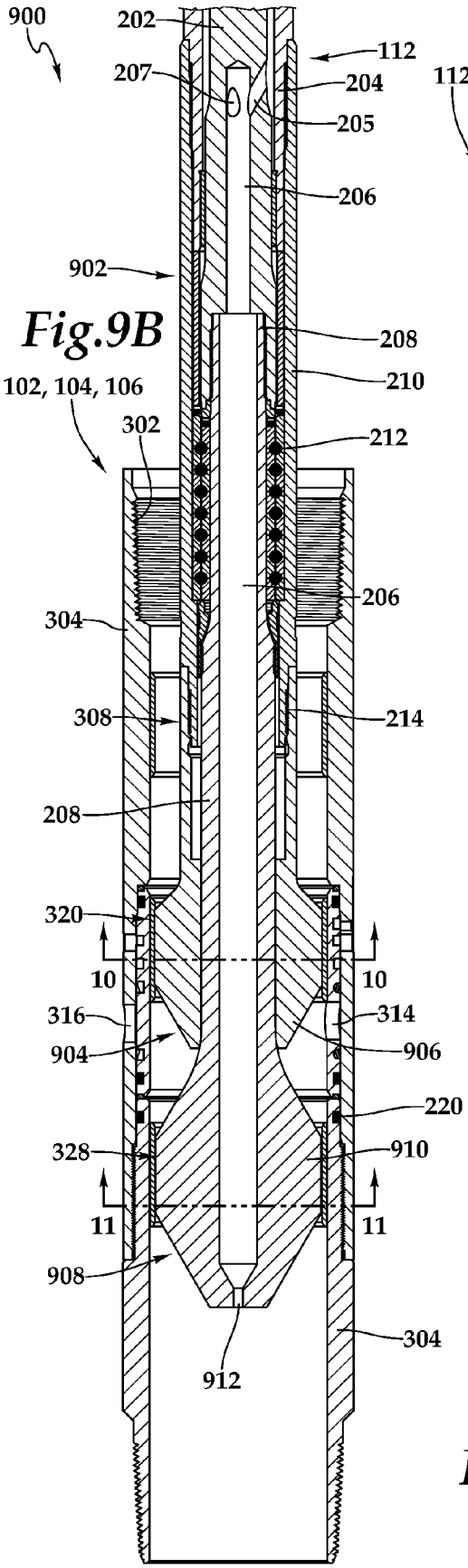
FIGS. 9A-9B are cross-sectional views of a downhole bidirectional apparatus with a rotary sleeve operable in a first direction according to another embodiment.
Figure 9A:
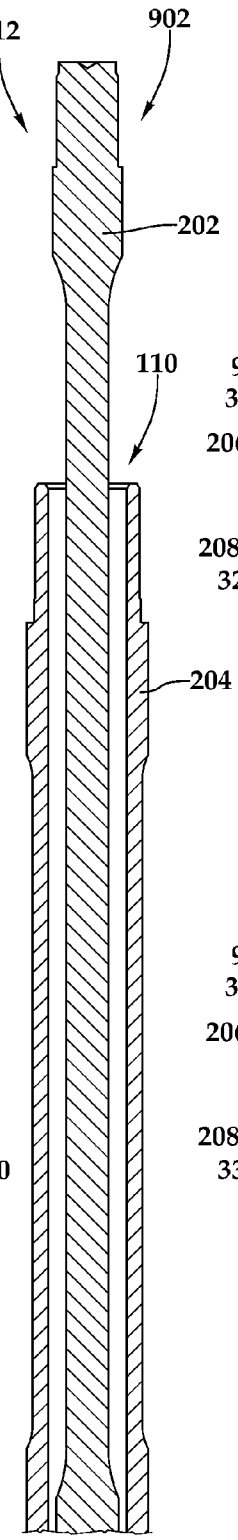

Referring to FIGS. 9A-9B and 3, another embodiment of a downhole bidirectional apparatus is schematically illustrated and generally designated 900. In general, this embodiment may include splines on gripping device 902 in place of hydraulically operated dogs and will be described relative to rotary devices 102, 104, 106 above. All discussion above relative to rotary devices 102, 104, 106, rotary source 110, and gripping device 112 may apply and are noted by the same reference numerals as that described above and are incorporated herein. Accordingly, the description relating to these elements, components, functions, etc. will not be repeated here with reference to downhole bidirectional apparatus 900. In one embodiment, gripping device 902 may include a back pressure orifice 912 for controlling the back pressure through passageway 206.

Rotary sleeve 300 is disposed within tubular body 304 and is rotatable about the main axis of tubular body 304. It may rotate to the right or left depending on the torque being applied to it by gripping device 902. Rotary sleeve 300 also includes one or more holes or ports 314 that may either align with one or more ports 316 of tubular body 304 depending on the rotation of rotary sleeve 300 as best shown in FIG. 5. FIG. 9B shows ports 314 not in alignment with 316.

Gripping device 902 may include a first gripping member 904 including one or more splines 906 for engaging with lugs 310 of first lug section 308 and/or lugs 322 of second lug section 320. Additionally, gripping device 902 may include a second gripping member 908 including one or more splines 910 for engaging with lugs 330 of third lug section 328 and/or lugs 322 of second lug section 320.

Figure 13A:
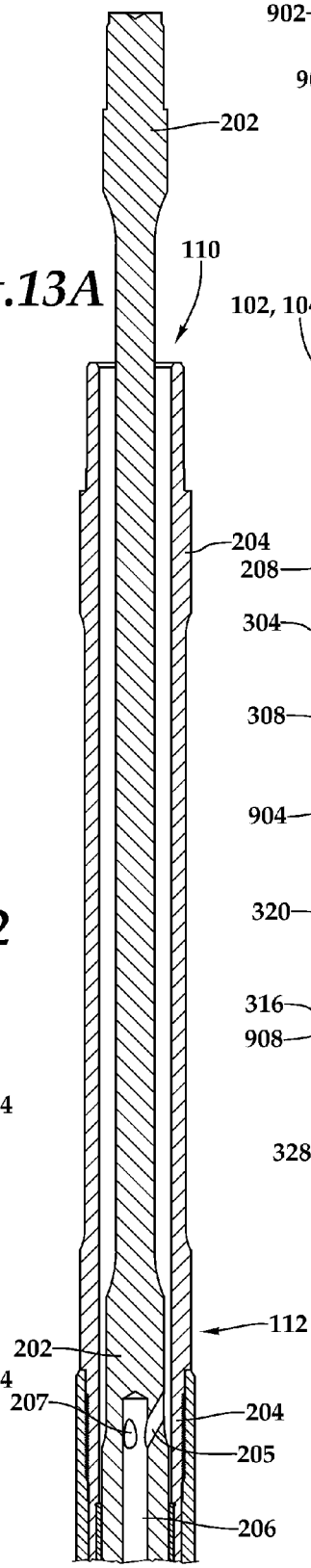
FIGS. 13A-13B are cross-sectional views of a downhole bidirectional apparatus with a rotary sleeve of FIGS. 9A-9B operable in a second direction according to an embodiment.
Figure 13B:
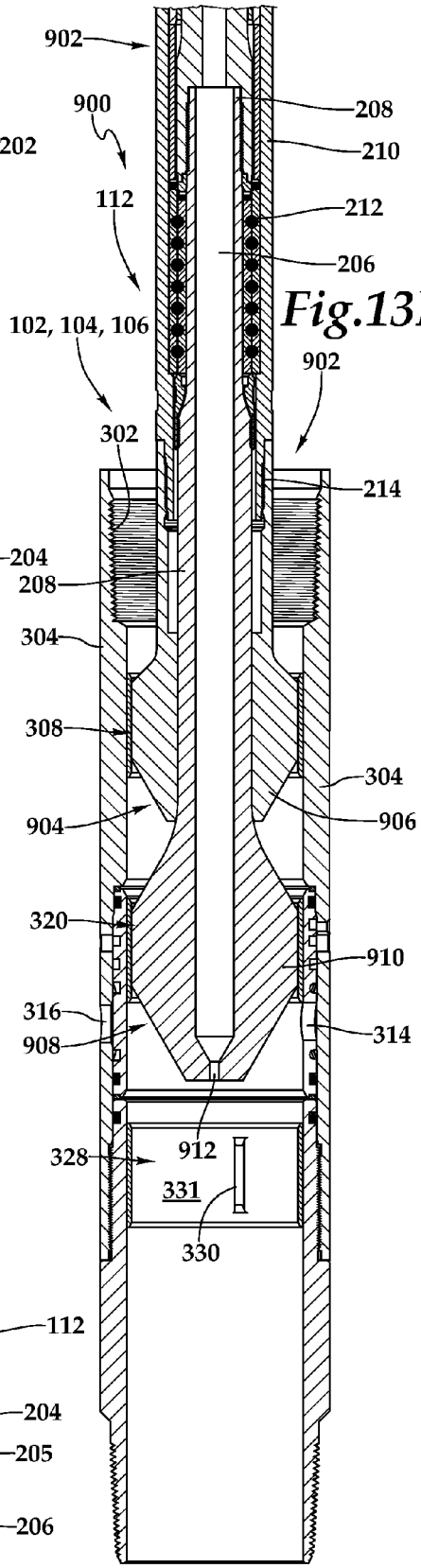

As shown in FIGS. 9A-9B, first gripping member 904 is engaged with second lug section 320 and second gripping member 908 is engaged with third lug section 328 for rotating rotary sleeve 300 in one direction. With reference now to FIGS. 13A-13B, rotary source 110 and gripping device 112 are shown positioned or moved up within rotary devices 102, 104, 106 such that first gripping member 904 is now engaged with first lug section 308 and second gripping member 908 is now engaged with second lug section 320 for rotating rotary sleeve 300 in the opposite direction as that described and shown in FIGS. 9A-9B. This bidirectional rotary force or motion provided by downhole bidirectional apparatus is produced by locating gripping device 112 in a specific set of lug sections and operating rotary source 110 to rotate rotary devices 102, 104, 106 in one direction or the other as follows.

As shown in FIGS. 9A-9B, second gripping member 222 is shown engaged with lugs 330 of third lug section 328 and first gripping member 216 is shown engaged with lugs 322 of second lug section 320. Lugs 330 of third lug section 328 are stationary relative to lugs 322 of second lug section 320 of rotary sleeve 300. When rotary source 110 is operated, second gripping member 908 remains stationary relative to rotary sleeve 300 and rotary sleeve 300 is rotated in a first direction by first gripping member 904. As shown in FIGS. 13A-13B, second gripping member 908 is shown engaged with lugs 322 of second lug section 320 and first gripping member 904 is shown engaged with lugs 310 of first lug section 308. Lugs 310 of first lug section 308 are stationary relative to lugs 322 of second lug section 320 of rotary sleeve 300. When rotary source 110 is operated, first gripping member 904 remains stationary relative to rotary sleeve 300 and rotary sleeve 300 is rotated in a second or opposite direction to that of first direction by second gripping member 908. Swivel 108 enables rotary source 110 to be rotated relative to second gripping member 908 when it is in a stationary position. This enables downhole bidirectional apparatus to provide bidirectional rotary force or motion to rotary devices 102, 104, 106 with a unidirectional rotary source 110, in one embodiment.

Figure 10:
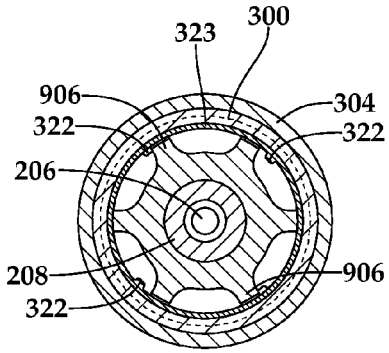
FIG. 10 is a cross-sectional view of the downhole bidirectional apparatus of FIG. 9B taken along line 10-10.
Figure 11:
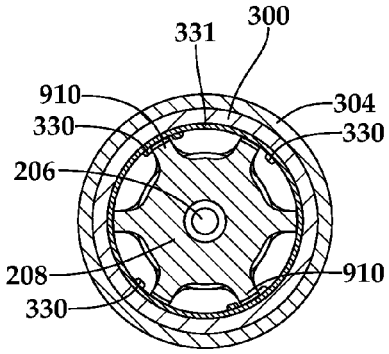
FIG. 11 is a cross-sectional of the downhole bidirectional apparatus of FIG. 9B taken along line 11-11.

Turning now to FIG. 10 a cross-sectional view of first gripping member 904 engaged with second lug section 320 is shown. In this embodiment, splines 906 of first gripping member 904 are engaged with lugs 322. Referring now to FIG. 11, a cross-sectional view of second gripping member 908 engaged with third lug section 328 is shown. In this embodiment, splines 910 of second gripping member 908 are engaged with lugs 330.

Figure 12:
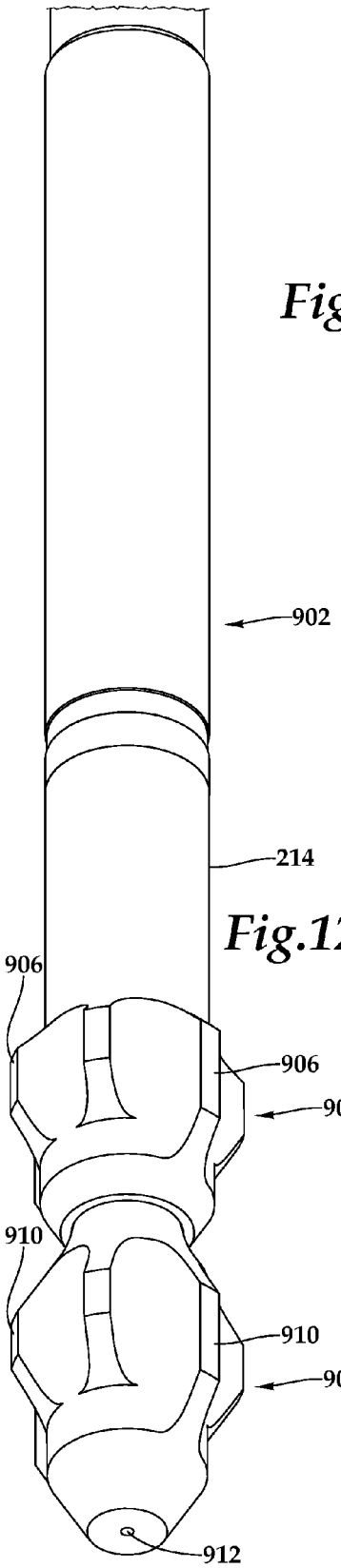
FIG. 12 is a perspective view of the downhole bidirectional apparatus of FIGS. 9A-9B according to an embodiment.

Rotary devices 102, 104, 106 of downhole bidirectional apparatus 100 may include any number of lugs disposed within the inner surface or periphery of rotary devices 102, 104, 106. As shown in FIGS. 10-11, there are six lugs spaced substantially equally apart about the inner surface of first lug section 308, second lug section 320, and third lug section 328. Although six lugs per lug section are shown, downhole bidirectional apparatus may include any number of lugs or arrangement of lugs within rotary devices 102, 104, 106, for example. Likewise, gripping device 902 may include first gripping member 904 and second gripping member 908 with any number and orientation of splines as desired. FIG. 12 shows a perspective of gripping device 902 with first gripping member 904 and second gripping member 908, according to one embodiment.

Figure 14A:
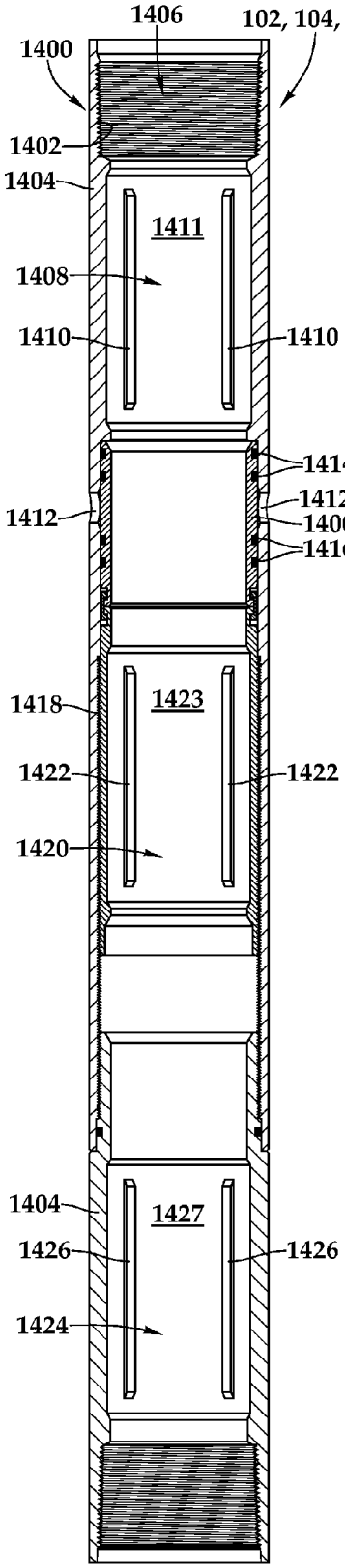
FIGS. 14A-14B are cross-sectional view of rotary sleeve of the downhole bidirectional apparatus according to another embodiment.
Figure 14B:
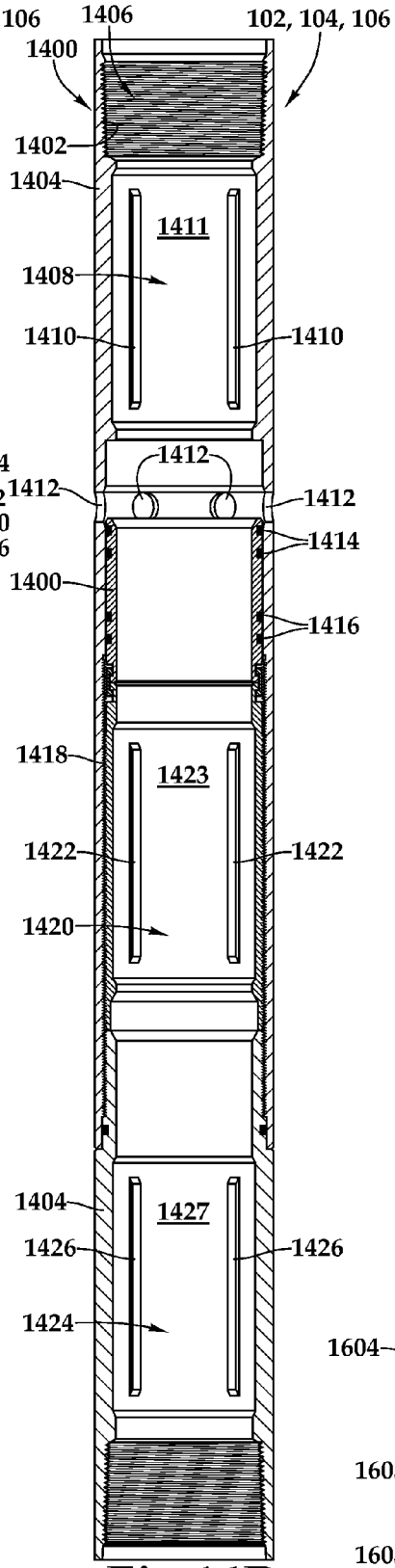

Referring now to FIGS. 14A-14B, another embodiment of rotary devices 102, 104, 106 is schematically illustrated and generally designated 1400. In this embodiment, rotary devices 102, 104, 106 may be a rotary sleeve 1400 that may include a threaded end 1402 for coupling with other tubular members of a casing string, such as casing 80. Rotary sleeve 1400 includes a tubular body 1404 defining a central passageway 1406 for accepting rotary source 110 and gripping devices 112, 902, in one embodiment. Rotary sleeve 1400 may further include a first lug section 1408 including one or more lugs 1410 for engaging with dogs or splines of gripping devices 112, 902, respectively, for example.

Additionally, first lug section 1408 may include or be part of a tubular inset 1411 that is pressed, attached, connected, and/or disposed, about the inside periphery of tubular body 1404, in one embodiment. In one embodiment, tubular inset 1411 and tubular body 1404 are a two-piece or multi-piece construction that are joined together. In another embodiment, tubular body 1404 is formed with first lug section 1408 as part of tubular body 1404, and lugs 1410 and tubular inset 1411 is not required to be pressed into tubular body 1404. Rotary sleeve 1400 may further include seals 1414, 1416 for providing a sealing engagement between tubular body 1404 and rotary sleeve 1400, in one aspect.

Rotary sleeve 1400 is disposed within tubular body 1404 and is rotatable about the main axis of tubular body 1404. It may rotate to the right or left depending on the torque being applied to it by any of the gripping devices discussed herein. Rotary sleeve 1400 also includes one or more holes or ports 1412 that may exposed or opened upon the rotation of rotary sleeve 1400 as described below. Rotary sleeve 1400 may also include a second lug section 1420 including one or more lugs 1422 for engaging with dogs or splines of upper gripping member and/or dogs or splines of lower gripping member, as further described below.

Additionally, second lug section 1420 may include or be part of a tubular inset 1423 that is pressed, attached, connected, and/or disposed, about the inside periphery of rotary sleeve 1400, in one embodiment. In one embodiment, tubular inset 1423 and rotary sleeve 1400 are a two-piece or multi-piece construction that are joined together. In another embodiment, rotary sleeve 1400 is formed with second lug section 1420 as part of rotary sleeve 1400, and lugs 1422 and tubular inset 1423 is not required to be pressed into rotary sleeve 1400. Second lug section 1420 and lugs 1422 are part of rotary sleeve 1400 in one embodiment.

Rotary sleeve 1400 may also include a threaded section 1418 between rotary sleeve 1400 and tubular body 1404 for moving rotary sleeve 1400 in an axially linear movement upon rotation one direction or the other by any of gripping members. Rotary sleeve 1400 may also include a third lug section 1424 including one or more lugs 1426 for engaging with dogs or splines of lower gripping member, as further described below. Additionally, third lug section 1424 may include or be part of a tubular inset 1427 that is pressed, attached, connected, and/or disposed, about the inside periphery of tubular body 1404, in one embodiment. In one embodiment, tubular inset 1427 and tubular body 1404 are a two-piece or multi-piece construction that are joined together. In another embodiment, tubular body 1404 is formed with third lug section 1424 as part of tubular body 1404, and lugs 1426 and tubular inset 1427 is not required to be pressed into tubular body 1404.

In one embodiment, any of the second gripping members described herein may be positioned adjacent to third lug section 1424 and any of the first gripping members described herein may be positioned adjacent to second lug section 1420. In this way, third lug section 1424 is held substantially stationary relative to the rotary motion imparted to second lug section 1420 that rotates upon operation of rotary source 110. With this rotation, rotary sleeve 1400 moves axially linearly downward within threaded section 1418 to expose/open ports 1412.

In another embodiment, any of the second gripping members described herein may be positioned adjacent to second lug section 1420 and any of the first gripping members described herein may be positioned adjacent to first lug section 1408. In this way, first lug section 1408 is held substantially stationary relative to the rotary motion imparted to second lug section 1420 that rotates upon operation of rotary source 110. With this rotation, rotary sleeve 1400 moves axially linearly upward within threaded section 1418 to close ports 1412. In yet another embodiment, based on threaded section 1418 having a threaded section 1418 with opposite threads, the operation as described above may be reversed.

In yet another embodiment, rotary devices 102, 104, 106 may include grooves disposed longitudinally axially in the inner surface of rotary devices 102, 104, 106 for engaging corresponding dogs or splines as described herein.

Figure 15:
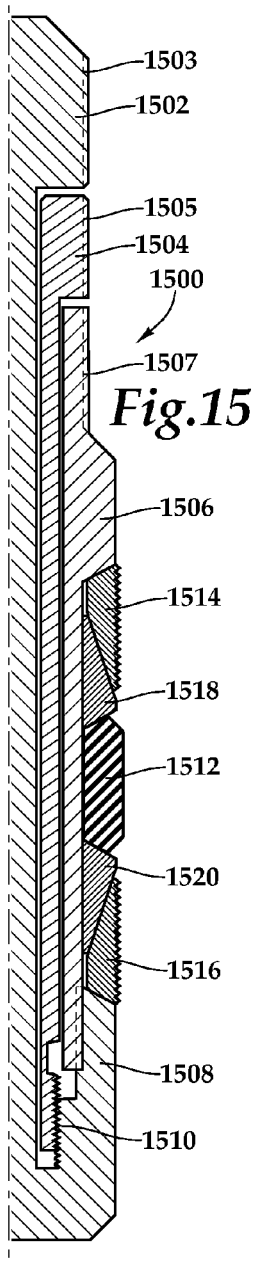
FIG. 15 is a cross-sectional view of a rotary set packer of the downhole bidirectional apparatus according to an embodiment.

Referring now to FIG. 15, a rotary set packer is schematically illustrated and generally designated 1500. Rotary set packer 1500 may be run into casing 80 in wellbore 78 on coiled tubing 66, in one embodiment. Any number of rotary set packer 1500 may be run in on a string of tubular members for setting against casing 80 in wellbore 78, for example. Rotary set packer 1500 may include an inner mandrel 1502 that may be coupled with other tubular members when run into casing 80 in wellbore 78. Inner mandrel 1502 may include one or more splines 1503 that extend outwardly as shown. In one embodiment, a driving member 1504 may be disposed about inner mandrel 1502 that moves axially linearly as it rotates as further described below. The axial linear motion is provided by the coupled engagement of driving member 1504 to an outer mandrel or wedge 1508 via a threaded connection 1510.

Additionally, rotary set packer 1500 may include an outer or packer mandrel 1506 that is disposed about driving member 1504 that is driven axially linearly by operation of driving member 1504, in one embodiment. Preferably, driving member 1504 and packer mandrel 1506 may include outwardly extending splines 1505 and splines 1507, respectively, for engaging with rotary set packer setting tool 1600 as described below with reference to FIG. 16. Also disposed about packer mandrel 1506 is a slip assembly 1514 in communication with packer mandrel 1506. Rotary set packer 1500 includes a wedge 1518 that has a camming outer surface for moving slip assembly 1514 outwardly when rotary set packer 1500 is operated. Rotary set packer 1500 further includes a bridge plug and/or packer 1512 for providing a sealing engagement between the inner surface of casing 80 and packer mandrel 1506. Rotary set packer 1500 also includes another wedge 1520 and slip assembly 1516 on the other side of bridge plug and/or packer 1512.

Figure 16:
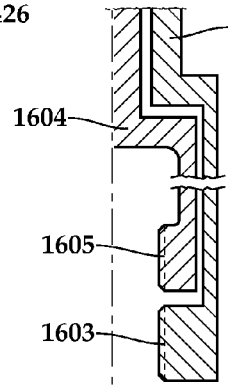
FIG. 16 is a cross-sectional view of a setting tool for the rotary set packer of the downhole bidirectional apparatus according to an embodiment.

Turning now to FIG. 16, a rotary set packer setting tool is schematically illustrated and generally designated rotary set packer setting tool 1600. Rotary set packer setting tool 1600 includes an outer member 1602 that may be coupled with outer mandrel 220 and/or outer mandrel 210. In one embodiment, outer member 1602 includes one or more inwardly extending splines 1603 for engaging with splines 1507 of packer mandrel 1506 and/or splines 1505 of driving member 1504, for example. Rotary set packer setting tool 1600 may also include an inner member 1604 that may be coupled with inner mandrel 208, in one embodiment. Inner member 1604 includes one or more inwardly extending splines 1605 for engaging with the splines 1505 of driving member 1504 and/or splines 1503 inner mandrel 1502, for example.

In operation, splines 1603 of outer member 1602 may be engaged with splines 1507 of packer mandrel 1506 and splines 1605 of inner member 1604 may be engaged with splines 1505 of driving member 1504. Rotary source 110 is operated, which rotates splines 1605 of inner member 1604 and splines 1505 of driving member 1504 causing threaded connection 1510 to draw driving member 1504 towards wedge 1508. This compresses slip assembly 1514, wedge 1518, bridge plug and/or packer 1512, wedge 1520, and slip assembly 1516 causing slip assembly 1514 and slip assembly 1516 to ride up wedge 1518 and wedge 1520, respectively, setting slip assembly 1514 and slip assembly 1516 firmly against the inner surface of casing 80, in one embodiment. Additionally, as slip assembly 1514 and slip assembly 1516 are set, bridge plug and/or packer 1512 is compressed causing it to extend outwards against the inner surface of casing 80 as well.

To reverse the operation, outer member 1602 and inner member 1604 are moved or pulled upwards such that splines 1605 of inner member 1604 are engaged with splines 1503 of inner mandrel 1502 and splines 1603 of outer member 1602 are engaged with splines 1505 of driving member 1504. Since splines 1503 of inner mandrel 1502 are stationary relative to the rotatable splines 1505 of driving member 1504, rotary source 110 drives splines 1603 of outer member 1602 in an opposite rotary direction causing driving member 1504 to extend away from wedge 1508 thus unsetting slip assembly 1514, slip assembly 1516, and bridge plug and/or packer 1512.

In addition to rotary set packer setting tool 1600, the present downhole bidirectional apparatus may also set similar devices, such as bridge plugs, and the like in a similar manner as described herein. Also, the present downhole bidirectional apparatus may be used with any type of rotary tools, devices, apparatus, and the like for performing desired functions in casing 80 in wellbore 78. Further, any of the devices, tools, and the like discussed herein may be used inside of tubing, casing, and open hole environments, for example.

Figure 17:
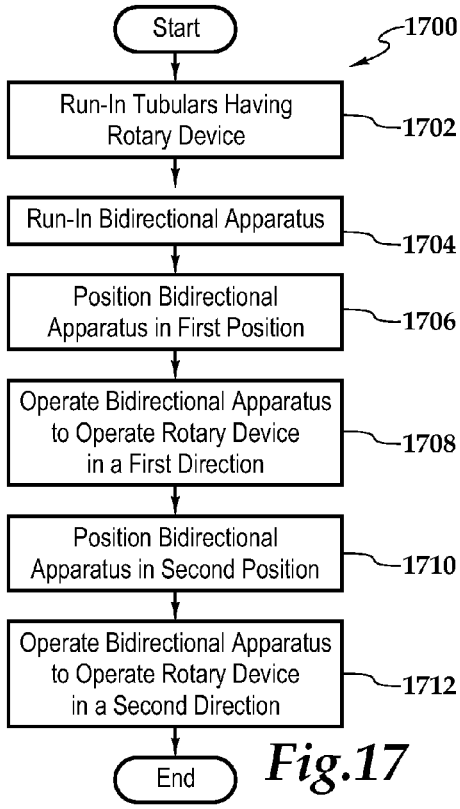
FIG. 17 is a flowchart of a process for operating a rotary device according to an embodiment.

The present downhole bidirectional apparatus further includes methods of using downhole bidirectional apparatuses. With reference to FIG. 17, an embodiment of a method for operating a downhole bidirectional apparatus is schematically and generally designated 1700. In step 1702, tubulars and/or tubular members, such as casing 80, are run into wellbore 78. This step may include making up a casing string that includes one or more rotary devices 102, 104, 106, for example. Rotary devices 102, 104, 106 may be any type of rotary device that may be operated in one or two directions, for example. Preferably, rotary devices 102, 104, 106 are rotatable in two directions. This step may further include performing cementing operations to cement casing 80 in wellbore 78, for example.

In step 1704, swivel 108, rotary source 110, and gripping device 112 are run into casing 80 to a desired one of rotary devices 102, 104, 106. In step 1706, gripping device 112 is positioned relative to one of devices 102, 104, 106 such that gripping device 112 operates rotary devices 102, 104, 106 in a first direction. For example, this step may include positioning first gripping member adjacent to one of the first lug sections and second lug sections. In another example, this step may include positioning first gripping member adjacent to one of the second lug section and the third lug sections.

In step 1708, fluid is pumped through the central passageway of coiled tubing 66 or the annulus between coiled tubing 66 and the inner surface of casing 80, for example, which operates rotary source 110 for rotating one of the first gripping member and the second gripping member to rotate and operating rotary devices 102, 104, 106. In step 1710, gripping device 112 is moved upwards or downwards relative to rotary devices 102, 104, 106 for presenting first gripping member and second gripping member to a different lug section as described herein that will operate rotary devices 102, 104, 106 in an opposite rotary direction as described above. In step 1712, fluid is pumped through the central passageway of coiled tubing 66 or the annulus between coiled tubing 66 and the inner surface of casing 80, for example, which operates rotary source 110 for rotating one of first gripping member and second gripping member to rotate and operating rotary devices 102, 104, 106.

In addition to those benefits described herein and due to the design of rotary devices 102, 104, 106, some of the rotary devices 102, 104, 106 described herein do not require additional axial linear room to operate, thus the sleeve assembly may be approximately about half the length of the shortest sleeve valves that are presently known, which makes them less expensive to manufacture.

In addition, any of the lugs described herein may be made out of a millable or degradable material that may be pressed manufactured into the tubular bodies and rotary sleeves. For example, any of the lugs described herein may be manufactured from a millable material, such as aluminum, which may be easily milled or degradable over time to provide a smoother inner surface through casing 80, in one embodiment. Additionally, any of the lugs described herein may be insertable into casing 80, which may be less expensive to manufacture than formed or machined lugs into casing 80.

Rotary source 110 as described above may be any type of rotary source, including pneumatically operated rotary sources, mechanically operated rotary sources, hydraulically operated rotary sources, electrically operated rotary sources, turbine rotary sources, and the like. In one embodiment, rotary source 110 may be a single-rotor, Moineau-type mud motors, for example.

Figure 18:
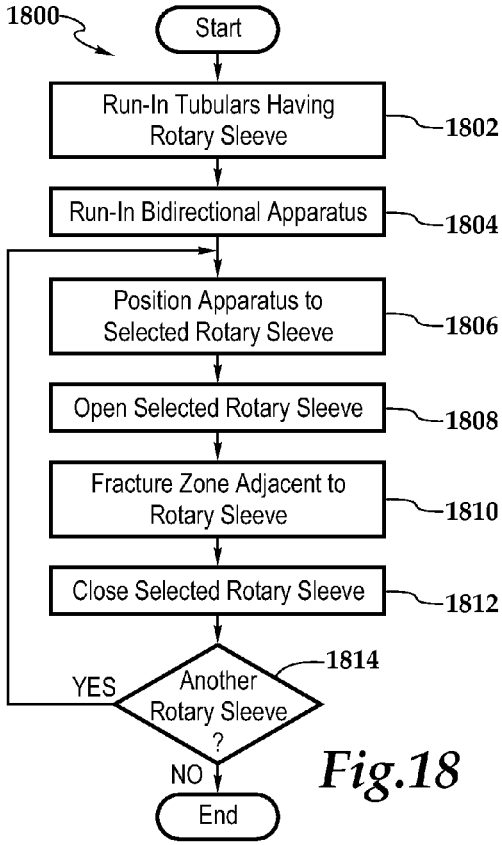
FIG. 18 is a flowchart of a process for fracturing a well according to an embodiment.

The present downhole bidirectional apparatus further includes methods of fracturing one or more zones in a wellbore. With reference to FIG. 18, an embodiment of a method for fracturing a wellbore is schematically and generally designated 1800. In step 1802, tubulars and/or tubular members, such as casing 80, are run into wellbore 78. This step may include making up a casing string that includes one or more rotary devices 102, 104, 106, for example. Rotary devices 102, 104, 106 preferably include rotary sleeves in this embodiment, such as rotary sleeves 300, 1400, that may be operated in preferably two directions for opening and closing rotary sleeves for fracturing one or more zones in formation 54, for example. Any number of rotary devices 102, 104, 106 may be run into wellbore 78 on casing 80. In one embodiment, rotary devices 102, 104, 106 may be spaced apart in the string of casing 80 such that they optimize the zones to be fractured in formation 54. In one aspect, casing 80 may be cemented in place in wellbore 78 prior to operation of rotary devices 102, 104, 106.

In step 1804, swivel 108, rotary source 110, and gripping device 112 are run into casing 80 to a desired one of rotary devices 102, 104, 106. In step 1806, gripping device 112 is positioned relative to one of devices 102, 104, 106 such that gripping device 112 operates rotary devices 102, 104, 106 and rotary sleeves in a first direction. For example, this step may include positioning first gripping member adjacent to one of the first lug sections and second lug sections. In another example, this step may include positioning first gripping member adjacent to one of the second lug section and the third lug sections. This step may include positioning gripping device 112 at the lowermost or bottommost rotary devices 102, 104, 106 first for fracturing the lowermost zones to be fractured in wellbore 78.

In step 1808, fluid is pumped through the central passageway of coiled tubing 66 and/or the annulus between coiled tubing 66 and the inner surface of casing 80, for example, which operates rotary source 110 for rotating one of the first gripping member and the second gripping member to rotate and open the rotary sleeve of the selected rotary devices 102, 104, 106. This step may include rotating the rotary sleeve until the ports of the rotary sleeve and the casing are aligned to provide fluid communication between wellbore 78 and the exterior of the rotary valve and/or casing through the aligned and opened ports. This step may include using any other types of rotary sources as described herein in place of a mud motor as the rotary source, for example.

In step 1810, fluid is pumped under pressure from the surface into wellbore 78 and then into formation 54 to fracture the formation substantially proximal and/or adjacent to the selected and opened rotary sleeve of rotary devices 102, 104, 106. If one or more rotary sleeves have been selectively opened, then those zones proximal or adjacent to the opened rotary sleeves may be fractured at one time. Any number of zones of formation 54 may be fractured individually or collectively with the present downhole bidirectional apparatus.

In step 1812, once the selected zones have been fractured, gripping device 112 is moved upwards or downwards relative to rotary devices 102, 104, 106 for presenting the first gripping member and the second gripping member to a different lug section as described herein that will operate the opened rotary sleeve of rotary devices 102, 104, 106 in an opposite rotary direction, thus closing the selected opened rotary sleeve of rotary devices 102, 104, 106 as described herein. In this step, closing the one or more of the rotary valves shuts off fluid communication between the wellbore 78 and the exterior of the one or more closed rotary valves.

In step 1814, a query is made regarding whether another rotary sleeve of rotary devices 102, 104, 106 is to be opened for fracturing another zone of formation 54. If the answer to this query is "yes," then the process returns to step 1806 and the rotary source 110 and gripping device 112 are positioned to another of the rotary devices 102, 104, 106 that are part of casing 80 in wellbore 78. If the answer to the query is "no," then the process or method may end by opening all, less than all, or any selected combination of the rotary valves of rotary devices 102, 104, 106 for enabling production of hydrocarbons from formation 54 through all, less than all, or any selected combination of the opened rotary devices 102, 104, 106, for example.

This method may include opening one or more of the rotary valves of rotary devices 102, 104, 106 at one time and then pumping fluid into formation 54 through the opened rotary valves of rotary devices 102, 104, 106 to fracture one or more zones at one time. These one or more opened rotary valves of rotary devices 102, 104, 106 may then be closed by rotary source 110 and gripping device 112 before repositioning rotary source 110 and gripping device 112 by other rotary valves of rotary devices 102, 104, 106 for opening and fracturing other zones in formation 54, for example.

Additionally, this method may include opening every other, or any other pattern of rotary valves of rotary devices 102, 104, 106 to fracture every other zone in formation 54 and then repeating the procedure by opening and fracturing those zones of formation 54 that hadn't been fractured. Further, this method may include closing opened rotary valves once they begin to produce a non-hydrocarbon, such as water for preventing production of water in casing 80 of wellbore 78.

One unique aspect of the present invention is that any of the rotary devices 102, 104, 106 may be operated, such as opening and closing rotary valves, at any time during fracturing and/or during production of fluids from formation 54 with relative ease.

Rotary source 110 as described above may be any type of rotary source, including pneumatically operated rotary sources, mechanically operated rotary sources, hydraulically operated rotary sources, electrically operated rotary sources, turbine rotary sources, and the like. In one embodiment, rotary source 110 may be a single-rotor, Moineau-type mud motors, for example.

While this invention has been described with reference to illustrative embodiments, this description is not intended to be construed in a limiting sense. Various modifications and combinations of the illustrative embodiments as well as other embodiments of the invention, will be apparent to persons skilled in the art upon reference to the description. It is, therefore, intended that the appended claims encompass any such modifications or embodiments.

What is claimed is:

1. A downhole bidirectional apparatus, comprising:
a first engagement section;
a second engagement section having a rotary device;
a third engagement section; and
a rotary source having a first rotary member and a second rotary member, the first rotary member disposed about the second rotary member, the first rotary member connected to a first gripping member and the second rotary member connected with a second gripping member, wherein the rotary device is rotatable in a first rotational direction when the second gripping member is engaged with the third engagement section and the first gripping member is rotatably engaged with the second engagement section, and wherein the rotary device is rotatable in a second rotational direction when the second gripping member is engaged with the second engagement section and the first gripping member is engaged with the first engagement section.

2. The downhole bidirectional apparatus as recited in claim 1, further comprising:
a swivel in communication with the rotary source.

3. The downhole bidirectional apparatus as recited in claim 1, wherein the first engagement section, second engagement section, and third engagement section have one or more lugs disposed about the periphery of their inner surface.

4. The downhole bidirectional apparatus as recited in claim 1, wherein the first engagement section, second engagement section, and third engagement section have one or more grooves formed axially in their inner surface.

5. The downhole bidirectional apparatus as recited in claim 1, wherein the first and second gripping members have one or more extendable dogs.

6. The downhole bidirectional apparatus as recited in claim 5, wherein the extendable dogs are extended by hydraulically operated pistons.

7. The downhole bidirectional apparatus as recited in claim 1, wherein the first and second gripping members have one or more radially extended splines.

8. The downhole bidirectional apparatus as recited in claim 1, further comprising:
at least one stop for stopping the rotation of rotary device.

9. The downhole bidirectional apparatus as recited in claim 1, wherein the rotary device has at least one port disposed therethrough.

10. The downhole bidirectional apparatus as recited in claim 1, wherein the rotary device is a rotary sleeve.

11. The downhole bidirectional apparatus as recited in claim 1, wherein the rotary device is a rotary set packer.

12. The downhole bidirectional apparatus as recited in claim 1, wherein the rotary device is a rotary set bridge plug.

13. A downhole bidirectional apparatus, comprising:
a circumferentially rotatable downhole device, comprising:
an inner mandrel;
a driving member slidably disposed about the inner mandrel;
an outer mandrel disposed about the driving member;
an operating member disposed about the outer surface of the outer mandrel, the operating member being operated by movement of the driving member; and
a tool for operating the circumferentially rotatable downhole device, comprising:
a rotary source having inner rotary member and an outer rotary member disposed about the inner rotary member, the inner rotary member connected to a second gripping member and the outer rotary member connected with a first gripping member, wherein the driving member moves axially linearly in a first direction when the first gripping member is engaged with the outer mandrel and the second gripping member is engaged with the driving member, and wherein the driving member moves axially linearly in a second direction when the first gripping member is engaged with the driving member and the second gripping member is engaged with the inner mandrel.

14. The downhole bidirectional apparatus as recited in claim 13, wherein the driving member and the outer mandrel are engaged in a threaded connection, wherein rotating one of the driving members and the outer mandrel operates the operating member.

15. The downhole bidirectional apparatus as recited in claim 13, wherein the first gripping member has one or more radially inwardly extending splines.

16. The downhole bidirectional apparatus as recited in claim 13, wherein the second gripping member has one or more radially inwardly extending splines.

17. The downhole bidirectional apparatus as recited in claim 13, wherein the inner mandrel has one or more radially outwardly extending splines.

18. The downhole bidirectional apparatus as recited in claim 13, wherein the driving member has one or more radially outwardly extending splines.

19. The downhole bidirectional apparatus as recited in claim 13, wherein the outer mandrel has one or more radially outwardly extending splines.

20. A method for operating a downhole tool, comprising:

positioning a bidirectional rotary device into a wellbore;

engaging a unidirectional rotary source to the bidirectional rotary device in a first position;

operating the unidirectional rotary source to operate the bidirectional rotary device in a first rotational direction;

engaging the unidirectional rotary source to the bidirectional rotary device in a second position; and operating the unidirectional rotary source to operate the bidirectional rotary device in a second rotational direction.

21. The method as recited in claim 20, wherein operating the unidirectional rotary source comprises:

pumping a fluid through the unidirectional rotary source.

22. The method as recited in claim 20, wherein engaging the unidirectional rotary source to the bidirectional rotary device in a second position comprises:

moving the unidirectional rotary source axially relative to the bidirectional rotary device from the first position to the second position.

23. The method as recited in claim 22, wherein the operating the unidirectional rotary source further comprises:

operating the unidirectional rotary source continuously during moving the unidirectional rotary source.

24. The method as recited in claim 20, wherein the engaging the unidirectional rotary source further comprises:

engaging the unidirectional rotary source with external splines on the bidirectional rotary device.

25. The method as recited in claim 20, wherein the engaging the unidirectional rotary source further comprises:

engaging the unidirectional rotary source with internal splines on the bidirectional rotary device.

* * * * *